United States Patent [19]

Stroh

[11] Patent Number: 4,688,461

[45] Date of Patent: Aug. 25, 1987

[54] GEAR-ADJUSTABLE BRIDGE

[76] Inventor: Paul F. Stroh, 10229 42nd Southwest, Seattle, Wash. 98146

[21] Appl. No.: 927,292

[22] Filed: Nov. 5, 1986

Related U.S. Application Data

[60] Division of Ser. No. 642,220, Aug. 17, 1984, Pat. No. 4,638,711, which is a continuation-in-part of Ser. No. 315,318, Oct. 26, 1981, Pat. No. 4,475,432.

[51] Int. Cl.[4] ..... G10D 3/04

[52] U.S. Cl. ..... 84/298; 84/267; 84/299; 84/312 R; 84/313

[58] Field of Search ..... 84/267, 297 R, 298, 84/299, 307, 312 R, 313

[56] References Cited

U.S. PATENT DOCUMENTS

| | | | |
|---|---|---|---|
| 2,714,326 | 8/1955 | McCarty | 84/299 |
| 4,064,780 | 12/1977 | Bond | 84/314 R |
| 4,430,919 | 2/1984 | Matsui | 84/299 |
| 4,487,100 | 12/1984 | Storey | 84/299 |
| 4,638,711 | 1/1987 | Stroh | 84/313 |

FOREIGN PATENT DOCUMENTS

| | | | |
|---|---|---|---|
| 10851 | 2/1913 | United Kingdom | 84/299 |

*Primary Examiner*—Lawrence R. Franklin
*Attorney, Agent, or Firm*—Ward Brown; Robert W. Beach

[57] ABSTRACT

The bridge of a guitar includes a movable bridge plate normally pivotable relative to the body of the guitar so as to change the string tension and produce a tremulous tone effect. Alternatively, the bridge-mounting plate can be locked in fixed position relative to the remainder of the guitar. A low friction mounting for the bridge-mounting plate consists of a linear, sharpened leading end or ends of the plate received in a linear transverse groove or grooves of a mounting flange. Preferably, the pivot axis of the bridge plate lies in a vertical plane closely adjacent to the location where the guitar strings cross the bridge so that pivoting movement of the bridge plate to produce the tremulous tone effect does not result in a large change of the height of the strings above the guitar body. A separate saddle is provided for each string and gear-actuated adjustment mechanism is operable to adjust the longitudinal position of each saddle. Mechanism is provided at the bridge for fine-tuning the strings and includes a separate bell crank for each string.

5 Claims, 20 Drawing Figures

Fig. 12
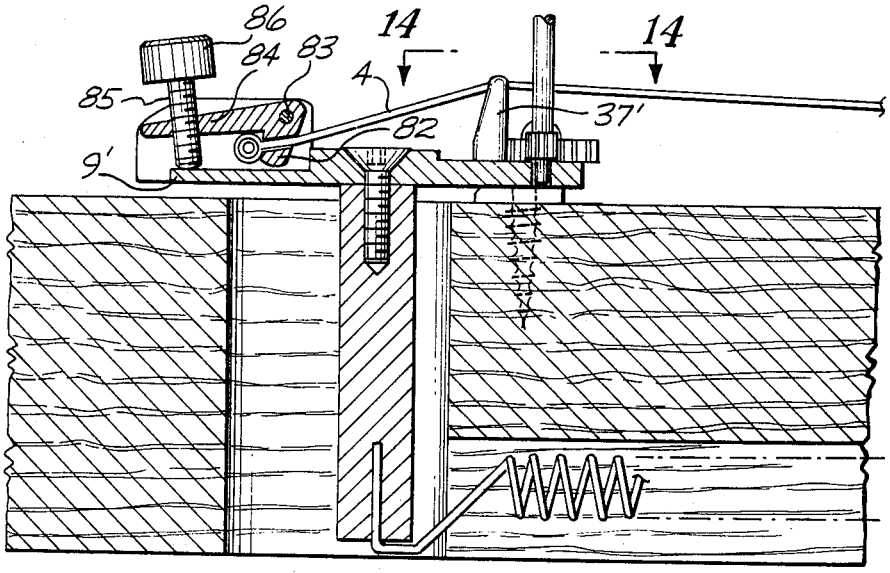
Fig. 13
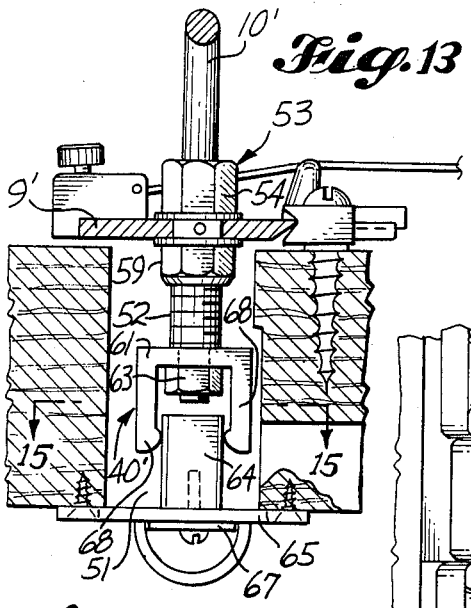
Fig. 15A
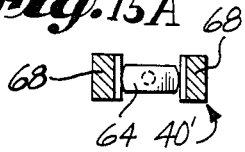
Fig. 15B
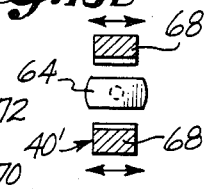
Fig. 16
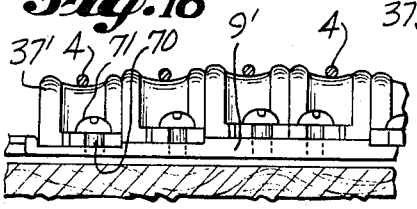
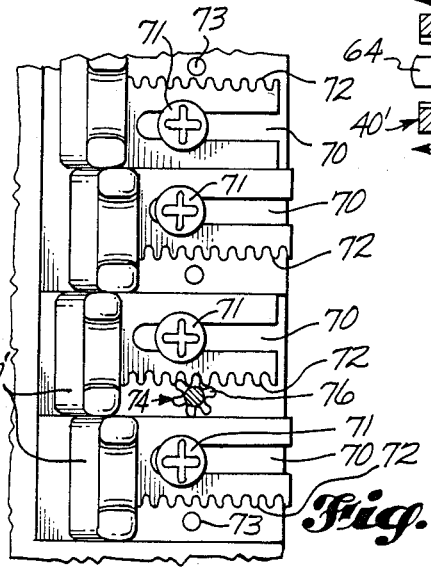
Fig. 14

GEAR-ADJUSTABLE BRIDGE

CROSS REFERENCE

This application is a division of my copending application Ser. No. 642,220, filed Aug. 17, 1984, U.S. Pat. No. 4,638,711, which is a continuation-in-part of my copending U.S. patent application Ser. No. 315,318 filed on Oct. 26, 1981, now U.S. Pat. No. 4,475,432

BACKGROUND OF THE INVENTION

1. Field of the Invention

The present invention relates to stringed musical instruments, particularly guitars, and, more particularly, primarily guitars having tremolo devices, that is, devices for rapidly changing the string tension so as to produce a tremulous tone effect.

2. Prior Art

At the soundboard or body end portion of a guitar, the guitar strings are anchored to a bridge which, in some guitars, can be manually reciprocated or oscillated relative to the guitar body so as to change the string tension and produce a tremulous tone effect. Without intentionally moving the bridge relative to the guitar body, a skilled musician can force a single string transversely of the neck of the guitar so as to alter the string tension, but for a guitar fitted with a conventional tremolo device, altering the tension of one string in this manner may cause movement of the bridge which changes the tensions of all of the other strings.

Additional problems with known guitars fitted with tremolo devices are that there is high friction between the movable bridge and the guitar body so that the bridge may not always return to precisely the same position, and the bridge plate is pivoted along an axis a substantial distance forward of the saddle members over which the guitar strings pass. As the bridge plate is pivoted the height of the strings above the guitar body changes substantially which, particularly for electric guitars having a pickup below the strings, is undesirable.

A further problem with known guitars whether or not fitted with tremolo devices is that the mechanism provided for adjusting the longitudinal position of the individual bridge saddles over which the guitar strings extend is complicated or inconvenient, as is any mechanism provided for adjusting the height of the individual saddles.

SUMMARY OF THE INVENTION

It is an object of the present invention to provide an improved tremolo device for a musical instrument of the type having several generally parallel strings which device is usable for producing a tremulous tone effect with respect to all of the strings but which, optionally, may be rendered inoperative such that a skilled musician can alter or "bend" the pitch of an individual string without affecting the other strings.

An additional object is to provide such a tremolo device including a movable bridge plate in which the bridge plate returns reliably to the same starting position after each use of the tremolo device.

Another object is to provide an improved bridge for a guitar having individual saddles over which the guitar strings extend and mechanism for quickly and easily adjusting the longitudinal position of each saddle.

A further object is to provide an improved bridge for a guitar having individual saddles over which the guitar strings extend and mechanism for quickly and easily adjusting the height of each saddle.

These and other objects are accomplished by the accessories described in detail below with reference to the accompanying drawings.

BRIEF DESCRIPTION OF THE DRAWINGS

FIG. 12 is a fragmentary section taken along line 12—12 of FIG. 11;

FIG. 13 is a fragmentary section taken along line 13—13 of FIG. 11 but the parts in assembled relationship;

FIG. 14 is a fragmentary section taken along line 14—14 of FIG. 12; FIGS. 15A and 15B are corresponding fragmentary sections taken along line 15—15 of FIG. 13 but with parts in different positions; and FIG. 16 is a fragmentary front elevation of the bridge portion of the guitar shown in FIG. 11 but with the parts in assembled relationship.

DETAILED DESCRIPTION

Figure 1:
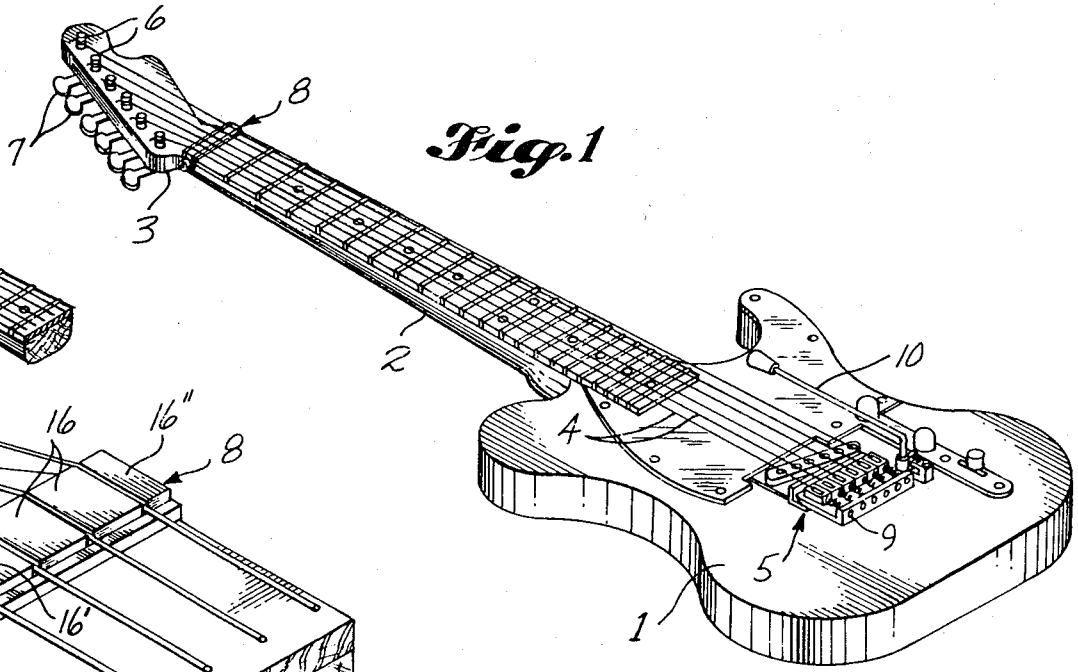
FIG. 1 is a top perspective of a guitar having tremolo accessories in accordance with the present invention.

The guitar shown in FIG. 1 is of conventional construction with the exception of the tremolo accessories in accordance with the present invention described further below. In general, the guitar includes a soundboard or body portion 1 from which the neck 2 projects and ends at the head portion 3. Several parallel strings 4 have their opposite ends anchored, respectively, to the bridge portion 5 carried by the body and the conventional tension or tuning adjustment mechanism in the form of upright pins 6 rotatable by turning the adjustment screws 7. Between the neck and head portion of the guitar the strings pass over the nut 8. As is conventional with guitars fitted with tremolo devices, the bridge portion of the guitar includes a bridge mounting plate 9 which is movable by manipulation of a control handle 10 so as to effect rapid but slight alterations in the string tension and thereby produce a tremulous tone effect.

Figure 2:
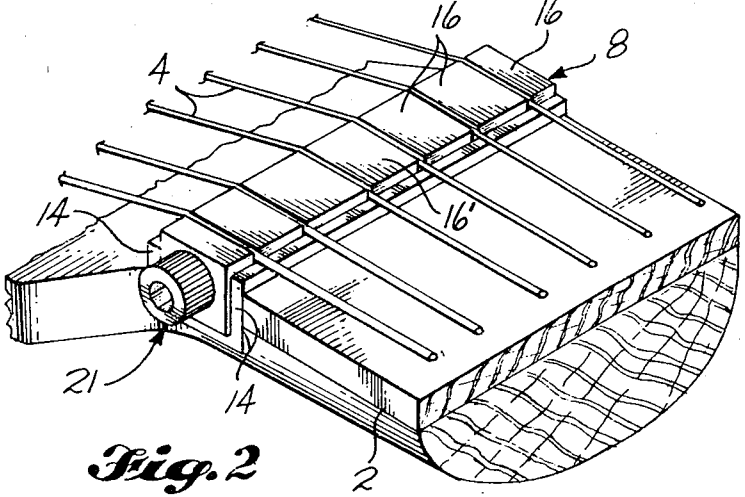
FIG. 2 is an enlarged fragmentary top perspective of the nut portion of the guitar of FIG. 1 showing in greater detail improved string-clamping mechanism in accordance with the present invention.
Figure 3:
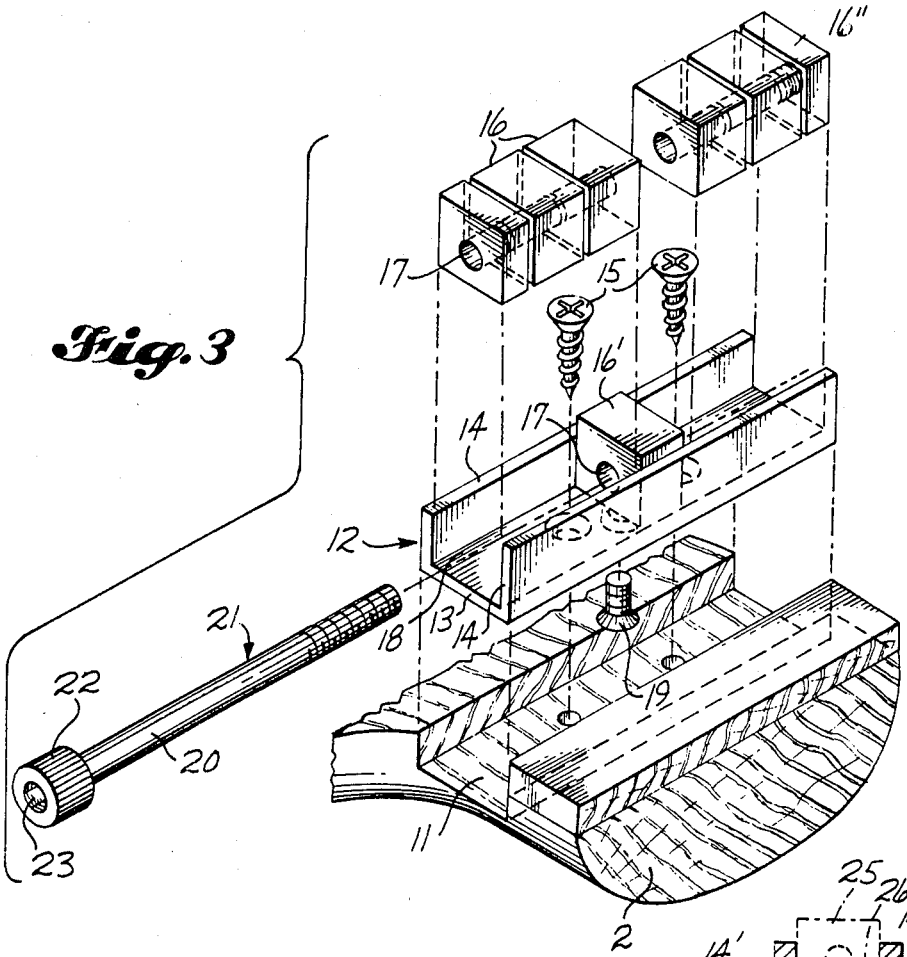
FIG. 3 is a corresponding, somewhat exploded, fragmentary top perspective.

As best seen in FIGS. 2 and 3, the nut portion of the guitar includes string-clamping mechanism in accordance with the present invention so as to prevent sliding movement of the strings over the nut by operation of the tremolo device. As best seen in FIG. 3, a groove 11 is cut transversely across the upper face of the guitar at the upper end of the neck 2 for receiving the rigid, generally U-shaped channel plate 12. The bottom web 13 of the channel plate is screwed into the bottom of the groove 11 with the upward projecting side flanges 14 of the channel plate in substantially contiguous engagement with the upright sides of the groove. The heads of the wood screws 15 securing the channel plate 12 in the groove 11 are countersunk in the upper surface of the web of the channel plate.

A row of separate, generally rectangular string-clamping blocks 16 having registered apertures 17 are arranged in side-by-side relationship in the upward opening groove 18 formed by the channel plate. The shape of each block is substantially complementary to the shape of the channel groove. Preferably, at least one of the blocks, such as the center block 16', is rigidly secured to the channel plate by a short machine screw 19 screwed into such center block from below and having its head countersunk in the underside of the web 13 of the channel plate. The upper end of such machine screw stops short of the aperture 17 of the block 16'.

The cross-sectional size of the registered apertures 17 through the string-clamping blocks 16 is sufficient that the shank 20 of a bolt 21 may be slid through them, with the exception of an end block 16'' which is in the form of a nut having a slightly smaller central aperture with threads complimentary to the threads of the bolt. The other end of the bolt has an enlarged knurled head 22 engageable against the other end block and adapting the bolt to be turned manually. Such enlarged head has an axial socket 23 of hexagonal cross section allowing additional tightening of the bolt.

As best seen in FIG. 2, the axial length of each string-clamping block, other than the end blocks, corresponds to the desired distance between adjacent strings. The height of the blocks is uniform such that the blocks project upward above the upper sides of the flanges 14 of the channel plate 12. Each guitar string 4 is fitted between adjacent blocks, whereupon the bolt 21 is tightened to clamp the strings in vicelike fashion, thereby preventing movement of the strings across the nut. Loosening of the single bolt such as by an Allen wrench which, when not in use, can be held in a bracket beneath the head of the guitar, allows tuning the guitar by turning the tension adjustment screws.

Figure 4:
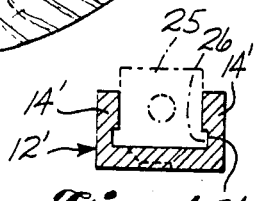
FIG. 4 is a somewhat diagrammatic transverse cross section of alternative string-clamping mechanism in accordance with the present invention.

In the alternative embodiment shown in FIG. 4, the modified channel plate 12' has side flanges 14' with undercut grooves 24 at their bases; and, as illustrated in broken lines, the string-clamping blocks 25 fitted in such plate can have corresponding projections 26 received in the grooves 24 for more positive sliding mounting of the blocks in the channel plate. In the embodiment of FIGS. 2 and 3, up and down movement of the blocks relative to the channel plate is prevented by the bolt 21 extending through the block 16' rigidly secured to the channel plate; whereas in the embodiment of FIG. 4 up and down sliding movement of the blocks 25 is prevented by the projections 26 of the blocks being received in the slots 24 of the upright flanges 14' of the channel plate 12'. Nevertheless, even in the embodiment of FIG. 4 it is preferred that at least one of the blocks 25 be rigidly secured to the channel plate 12' so as to prevent sliding of the row of blocks lengthwise of the channel plate.

Figure 5:
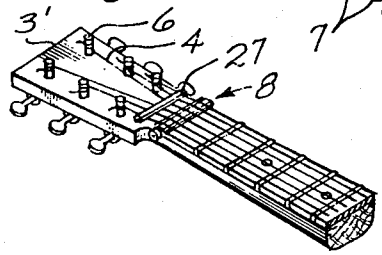
FIG. 5, on the drawing sheet with FIGS. 1 and 2, is a fragmentary top perspective of the upper neck and head portions of another guitar having string-clamping mechanism in accordance with the present invention, illustrating an optional feature of such mechanism.

In the form of guitar shown in FIG. 1, each of the rotatable anchoring pins 6 at the head of the guitar is substantially aligned with the portion of its string extending lengthwise of the neck. For a guitar in which the pins are not aligned with their strings, such as the guitar shown in FIG. 5, it is preferred that the strings 4 be aligned prior to crossing the nut 8. The alignment bar 27 shown in FIG. 5 is mounted between the anchoring pins 6 and the nut and has a transversely extending groove in its underside for each string. The underside of the alignment bar is spaced above the upper surface of the head 3' of the guitar. In the preferred embodiment, mounting screws extend downward through the alignment bar and through spacers fitted between the underside of the bar and the upper surface of the head of the guitar.

While the head end portions of the strings flare outward from the alignment bar to their rotatable anchoring pins, between the bar and the nut the strings are aligned with the spaces between the string-clamping blocks of the nut. It also is preferred that the height of the grooves in the alignment bar be at least as great as the diameter of the largest string so that the strings are securely received in their grooves, and that the alignment bar hold the strings no higher than the top of the nut so that the strings are positively held downward between the string-clamping blocks.

Figure 6:
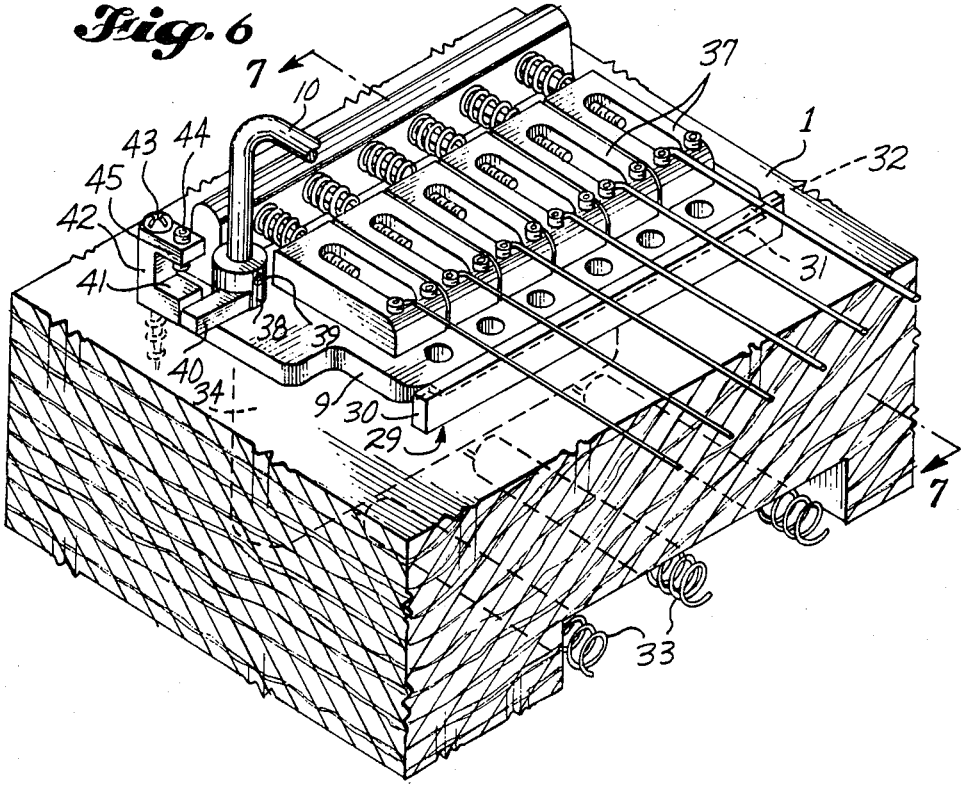
FIG. 6 is an enlarged fragmentary top perspective of the bridge portion of the guitar of FIG. 1.
Figure 7:
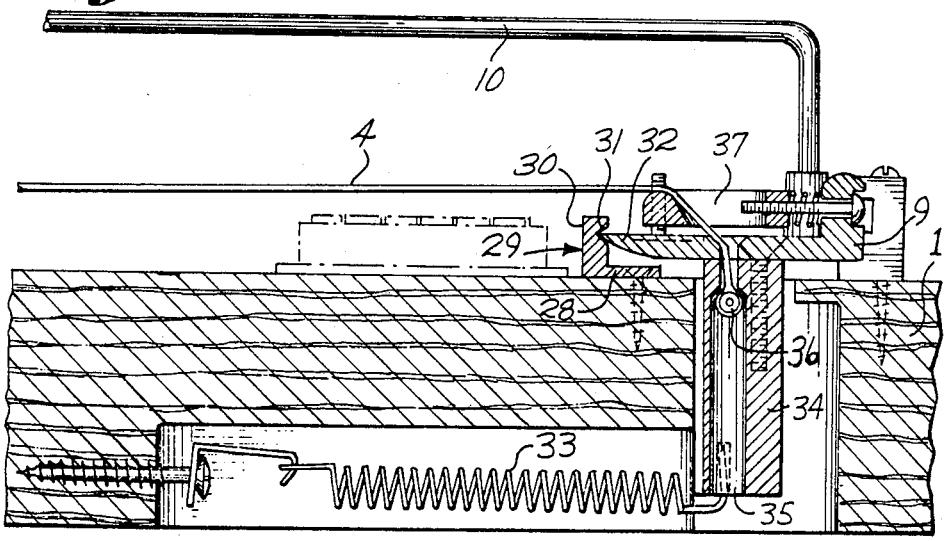
FIG. 7 is a section taken generally along line 7—7 of FIG. 6.
Figure 8:
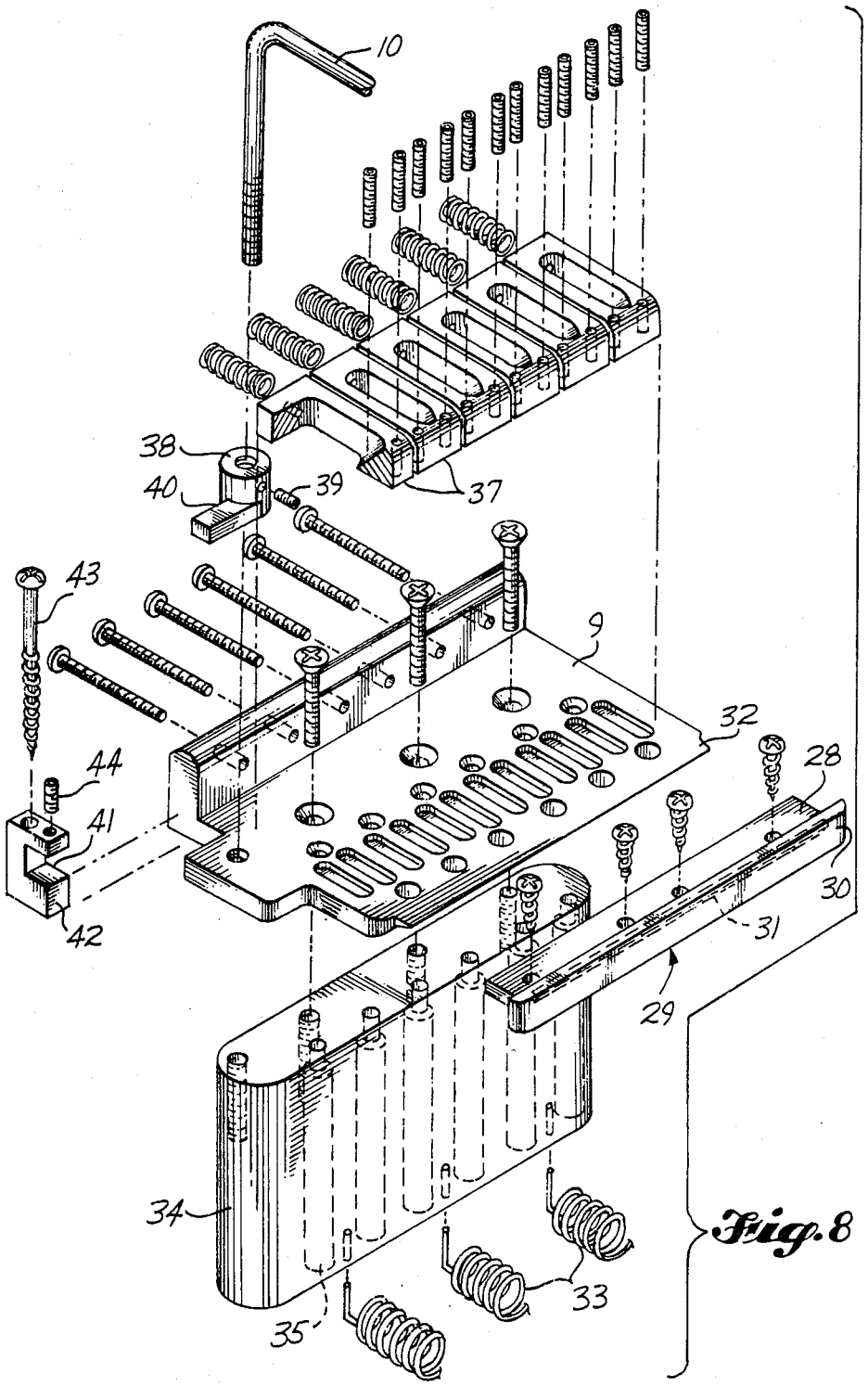
FIG. 8 is an exploded top perspective of such bridge portion.

As shown in FIGS. 6, 7 and 8, a further improvement of the present invention is the mounting of the movable bridge mounting plate 9 to the body portion 1 of the guitar. As best seen in FIG. 7, one flange 28 of an angle plate 29 is screwed to the body of the guitar with its other flange 30 projecting upward. Such upward-projecting flange has an angle groove 31 extending transversely of the guitar but ending short of the opposite ends of the angle plate 29. The leading end 32 of the bridge mounting plate 9 decreases in thickness toward its sharp tip fitted in the groove.

The tension of the guitar strings 4 tends to pull the bridge plate upward but this force is offset by the tension of the return springs 33 connected between the underside of the guitar body and an upright mounting block 34 rigidly connected to the underside of the bridge mounting plate. Sliding of the bridge mounting plate transversely of the length of the guitar is not permitted because the groove 31 does not extend to the opposite ends of the angle plate 29. The angle defined by the inner faces of the groove is greater than the angle defined by the outer faces of the tapered leading end portion 32 of the bridge mounting plate so that the only point of contact of the bridge mounting plate with the body portion of the guitar is by its sharpened leading end in the base of the groove. This low friction mounting assures return of the bridge mounting plate to precisely the same position after each manipulation of the tremolo device.

Conventionally an upright mounting block for a movable bridge, corresponding to the upright block 34, has upright bores for receiving the individual guitar strings with the strings being anchored at the base of the block. In accordance with the present invention, the upright mounting block 34 has bore 35 of a diameter so as to permit each string to be anchored toward the upper end of the block, such as by a mounting peg 36 best seen in FIG. 7. This reduces the length of string from its anchoring point to the point where it crosses the bridge, such as at the leading end of its individual slotted adjustment block or saddle 37, which decreases the possibility that any substantial length of string will slide over the bridge during manipulation of the tremolo device, without requiring clamping the string to the bridge.

Figure 9:
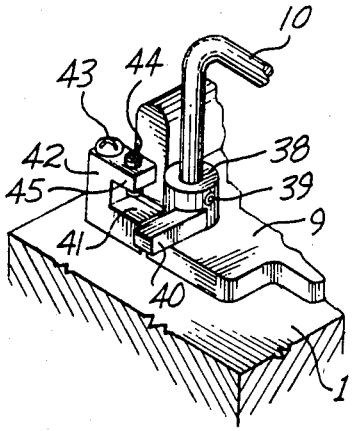
FIG. 9 and 10, on the drawing sheet with FIGS. 3 and 4, are corresponding enlarged fragmentary top perspectives of a rear corner of the bridge portion of the guitar of FIG. 1, with parts in different positions.
Figure 10:
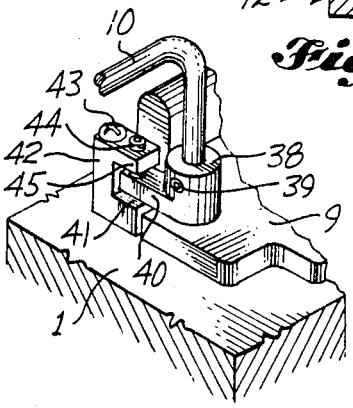

A further improvement of the present invention is the provision of mechanism for locking the bridge mounting plate in fixed position relative to the body of the guitar, best seen in FIGS. 6, 9 and 10. As is conventional, the perpendicularly bent control handle 10 of the tremolo device may be turned through an angle of at least 90° between an operating position in which its upper end portion extends forward generally lengthwise of the guitar to a position extending transversely of the guitar and away from the bridge. In accordance with the present invention, a collar 38 is fixed to the lower end portion of the control handle by a set screw 39 and has a generally radially projecting latch member or arm 40.

In the operating position of the control arm extending lengthwise of the guitar, shown in FIG. 9, the latch arm 40 extends transversely of the guitar and away from the bridge. When the control arm is swung to inoperative position extending transversely of the guitar, shown in FIG. 10, the arm 40 is swung rearward into the mouth 41 of a lock or catch member or block 42 fixed to the guitar body by a wood screw 43. Preferably, such catch block is mounted to the rear of the bridge plate and has its mouth or slot 41 opening forward. An upright adjustment screw 44 extends through the upper jaw of the catch block into close proximity to the upper side of latch arm 40 so as to prevent appreciable movement of the latch arm, the control arm and the bridge mounting plate when the control handle is swung to the inoperative position. Consequently, the tension and pitch of an individual string can be altered manually without causing swinging movement of the bridge mounting plate which would alter the tensions of all of the other strings. With the control arm swung forward, the latch arm is freed from the catch block and the control arm can be manipulated to produce a desired tremulous tone effect.

Figure 11:
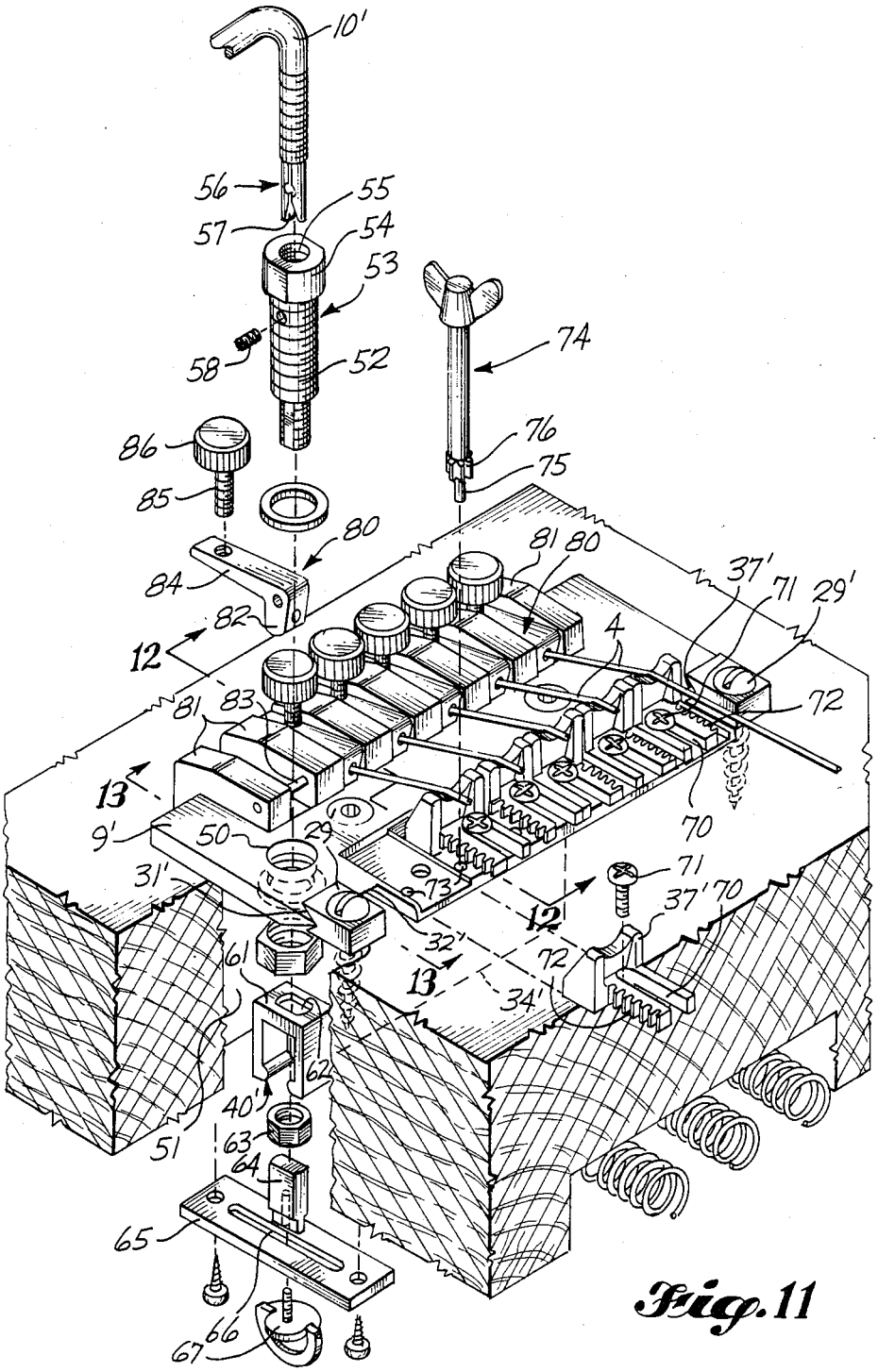
FIG. 11 is an enlarged fragmentary top perspective of the bridge portion of a guitar of the same general type shown in FIG. 1 but with a modified bridge in accordance with the present invention with some parts shown in exploded relationship.

In the modified bridge shown in FIGS. 11 through 16 the bridge mounting plate 9' is pivoted to the guitar body but, as best seen in FIG. 11, the opposite sides of the leading portion of the bridge mounting plate 9' are notched and have straight sharpened forward edges 32' lying in a common vertical plane spaced rearward from the forward end of the bridge plate. Such sharpened edges 32' fit in straight angle grooves 31' of separate flanges or blocks 29' rigidly secured to the guitar body and preventing any substantial movement of the bridge plate transversely of the guitar.

Preferably the vertical plane containing the sharpened edges 32' is closely adjacent to the location where the strings 4 pass over the bridge, namely, the upper edge portions of the individual saddles 37', so that pivoting movement of the bridge by manipulation of the control arm 10' does not result in a large change in the height of the strings above the guitar body. For example, if the pivot axis of the bridge plate is a substantial distance forward of the point where the guitar strings cross the bridge, upward pivoting of the bridge plate can move the strings farther above the guitar body which can affect the sensing of string vibration by the pickup of an electric guitar.

Another modification of the bridge shown in FIGS. 11 through 16 is the mechanism provided for locking the horizontal bridge mounting plate 9' relative to the body of the guitar. As seen in FIG. 11, the bridge plate has a hole 50 at one side offset from the upright bridge mounting block 34' which is rigidly secured to the underside of the bridge plate 9', but opening into the guitar cavity 51 that receives the upright block 34'. Such hole 50 loosely receives the central portion 52 of a stepped bolt 53 having an enlarged head 54. The lower end portion of the control handle 10' can be inserted into the upright blind bore 55 in the bolt head 54 and central portion 52. The control handle can be manually removed from the bolt and, in the preferred embodiment, the bottom and portion 56 of the control handle has an upright slot 57 for receiving a pin 58 extending transversely across the bore 55.

As seen in FIG. 13, the bolt 53 is inserted through the hole of the bridge mounting plate 9' and is held in position by a nut 59 screwed onto the central threaded portion 52 of the bolt. The bolt head 54 and nut 59 are spaced from the corresponding surfaces of the bridge mounting plate by washers to retain the bolt firmly in position but allow it to be turned by turning the control handle 10'.

As best seen in FIG. 11, the bottom end portion 60 of bolt 53 is of reduced diameter and, although threaded, has flattened opposite upright sides. The web 61 of an inverted U-shaped latch member 40' has a through slot 62 of a shape complemental to the exterior shape of the bottom end portion of the bolt and, as seen in FIG. 13, is slid upward over the reduced diameter bottom end portion of the bolt and retained in position by a nut 63.

The catch member or block 64 for the latch is mounted in the guitar cavity 51. An elongated plate 65 extends across the cavity, longitudinally of the guitar, and is rigidly secured to the underside of the guitar body by screws. Such plate has an elongated keyway 66 receiving a reduced thickness bottom end portion of the catch block 64. A thumbscrew 67 can be used to secure the catch block at any selected location along the length of the keyway.

As seen in FIG. 13, the upward-projecting enlarged portion of the catch block 64 is positioned to be closely fitted between the downward-projecting legs or flanges 68 of the inverted U latch member 40'. Such position is also shown in FIG. 15A which corresponds to the position of the control arm 10' indicated in FIG. 11 where the horizontal upper end portion of the arm extends perpendicularly outward from the guitar body. In such position the bridge mounting plate 9' and, consequently, the remainder of the bridge cannot be pivoted relative to the guitar body so that the tremolo accessory is rendered inoperative. Turning of the control arm 90°, however, rotates the inverted U latch member to the position indicated in FIG. 15B where the latch, the bolt holding it and the bridge plate in which the bolt is mounted are free to pivot about an axis extending transversely of the guitar to change the string tension for a tremulous tone effect.

In use, the guitar is tuned by changing the string tension with the thumbscrew 67 loosened, so that the catch block 64 is slidable along the length of the keyway 66 in the plate 65. After tuning of the guitar, the thumbscrew is tightened. Whenever the bridge plate is locked relative to the guitar body, the bridge plate will be returned to the position in which the guitar was tuned. Otherwise locking of the bridge plate could swing it to a slightly out of tune position.

If desired the guitar cavity 51 can be enlarged rearward and the length of the plate 65 and its keyway can be extended to allow room for the catch block 64 to be moved rearward out of the mouth formed between the latch legs 68, in which case the the guitar can optionally be used the same as a guitar having a conventional tremolo mounting without mechanism for locking the movable bridge.

Another improvement of the modified bridge shown in FIGS. 11 through 16 is the provision of mechanism for "fine tuning" each of the individual guitar strings. As best seen in FIG. 11, a separate bell crank 80 is provided for each string, such bell cranks being swingably mounted between transversely spaced pivot mounting blocks 81 projecting upward from the trailing or rear end portion of the bridge plate 9'. As best seen in FIG. 12, each bell crank has a downward-projecting leg 82 to which an end of the corresponding string 4 is anchored substantially directly below the pivot pin 83 for that bell crank, and a rearward-projecting leg 84 with a threaded hole for the external threads of an adjustment screw 85 with an upper knurled head 86.

The tension of the guitar string 4 holds the bottom end of the screw 85 against the upper surface of the bridge plate, and the string can be loosened or tightened easily by manually turning the enlarged head 86 of the screw to swing the bell crank about its pivot pin 83 and, correspondingly, move the downward-projecting leg 82 of the crank forward or rearward.

Still another modification of the bridge shown in FIGS. 11 through 16 is the provision of mechanism for adjusting the longitudinal position of the individual saddles 37'. As best seen in FIG. 11, a separate saddle is provided for each string, of generally L shape with the upright leg of the L having a concave upper end portion against which the corresponding guitar string 4 is engaged. The elongated horizontal portion of the saddle extends forward from the upright portion and has a forward-opening slot 70 receiving the shank of a locking screw 71 threaded into the bridge mounting plate 9' for securing the saddle in a selected longitudinally adjusted position. Preferably each slot 70 is offset from the corresponding string 4 to allow convenient access to the locking screw for loosening or tightening it as best seen in FIG. 16. The leading end portion of the bridge plate is recessed to receive the saddles disposed toward its opposite longitudinal sides, and the inner longitudinal sides of such saddles are planar and engaged against the short steps of the bridge plate recesses. The two inner saddles rest on the flat central portion of the leading end portion of the bridge plate and have their adjacent planar inner sides in engagement. Consequently, each saddle is held in position extending longitudinally of the guitar strings. The height of each saddle can be the same and the depths of the recesses toward the outer portions of the bridge plate can be selected so that the strings are arranged in the desired arc as seen in FIG. 16.

As seen in FIG. 11, each of the saddles has gear teeth 72 along its outer side. A hole 73 is provided through the bridge mounting plate in the area of the teeth of each saddle. A special tool 74 has a bottom and 75 of reduced diameter for fitting in the holes 73 and a gear 76 having teeth that intermesh with the teeth 72 of any selected one of the saddles 37' when such bottom end 75 is inserted into the corresponding hole 73. With the appropriate locking screw 71 loosened slightly, the position of such saddle 37' can be adjusted precisely by manually turning the tool as illustrated in FIG. 14, whereupon the locking screw can be tightened to fix the location of the saddle.

Figure 17:
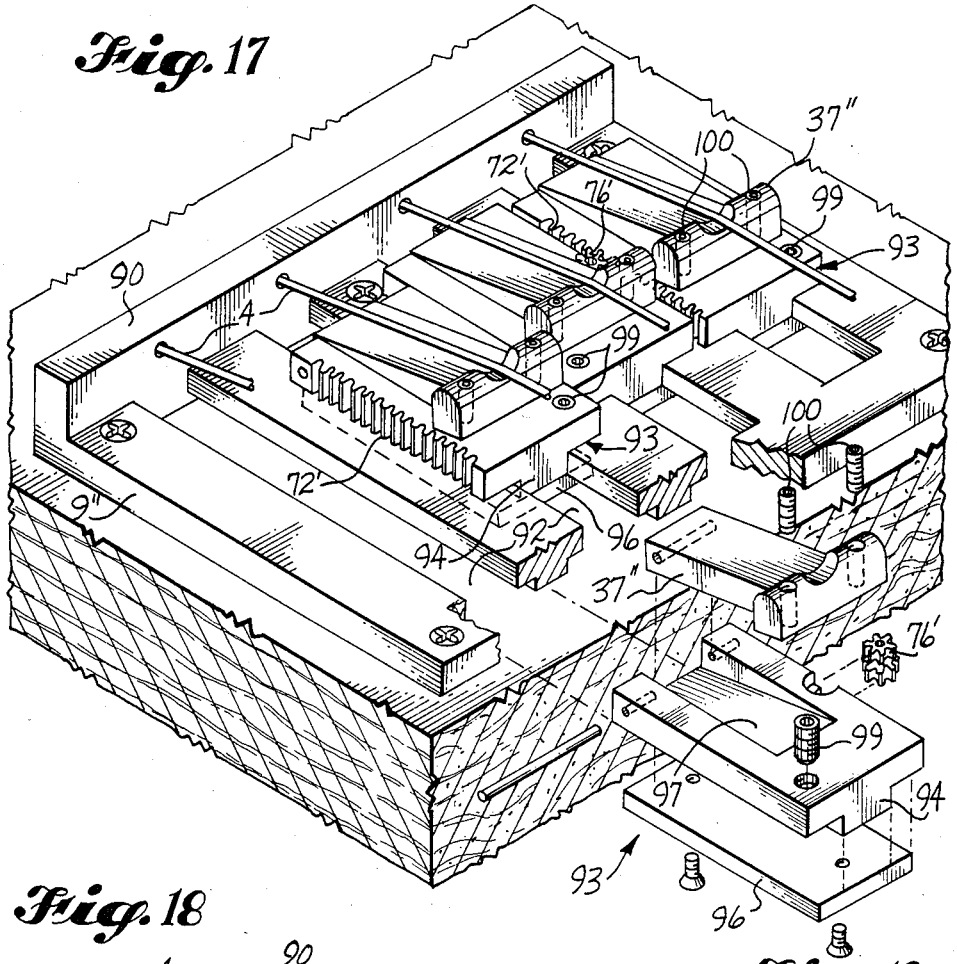
FIG. 17 is an enlarged fragmentary top perspective of the bridge portion of another guitar having another modified bridge in accordance with the present invention.
Figure 18:
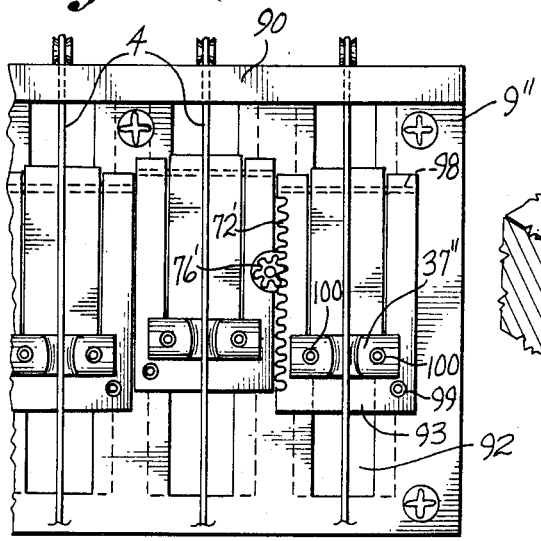
FIG. 18 is a fragmentary top plan of the bridge shown in FIG. 17.
Figure 19:
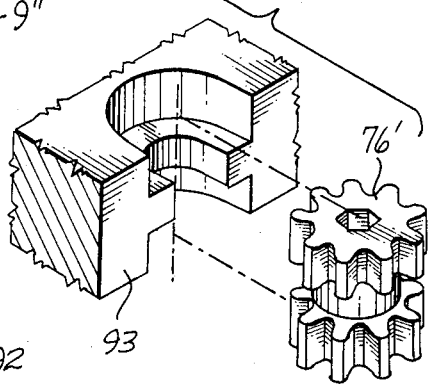
FIG. 19 is an enlarged fragmentary top perspective of a portion of the bridge shown in FIG. 17 and 18.

Another type of gear-actuated saddle adjustment mechanism is shown in FIGS. 17 through 19 which illustrate a bridge of the type rigidly secured to the upper surface of an electric bass guitar having four strings. The bridge plate 9'' has a rear upright portion 90 to which the individual guitar strings 4 are anchored and is attached to the top of the guitar body by screws. A slot 92 of inverted T cross section extends through the bridge mounting plate 9'' in alignment with each string for receiving a slide 93 carrying the individual saddle 37'' for that string. Each slide is formed of an upper portion having a narrow downward-projecting segment 94 closely but slidably fitted in its slot. Before the bridge plate is secured to the guitar, the narrow slide segment 94 is fitted in its slot 92 and a wider bottom plate 96 is rigidly secured to the bottom of such segment 94.

The upper surface of each slide has a forward and upward inclined groove 97. A pivot pin 98 extends across the trailing and deeper rear end portion of groove 97 and through the rear end portion of the corresponding saddle member 37''. Each saddle member has an upward-projecting front end portion with a concave top over which its individual guitar string passes.

The saddles 37'' and their slides 93 are provided in pairs. One slide of each pair has gear teeth 72' along its side adjacent to the other slide of the pair. Such other slide has a small rotatable gear 76' meshing with the teeth of the first saddle member of such pair, such gear being mounted in the adjacent edge portion of the second saddle member as illustrated in FIG. 17.

A set screw 99 is threaded through a corner of each slide and is engageable against the top of the bridge plate 9'' adjacent to the corresponding slot for such slide. For adjusting the position of the saddle, set screw 99 is loosened and the gear of that or the adjacent slide is turned to move the slide and its saddle lengthwise in the slot. For example, with the set screw 99 of the slide 93 shown at the top of Figure 16 loosened, turning the gear 76' mounted in the next lower slide moves the upper slide forward or rearward as desired. With such set screw of the upper slide tightened, the screw of the next lower gear-carrying slide can be loosened and turning such gear moves such next lower slide forward or rearward.

For adjusting the heights of the saddles, upright set screws 100 are threaded through each saddle at opposite sides of its top concave section and bear against the top of the slide for that saddle at opposite sides of its groove 97. Consequently, the vertical position of the saddle can be adjusted quickly and easily by turning such set screw 100 to swing the saddle about its pivot pin 98.

I claim:

1. In a guitar-like musical instrument having a body portion and several generally parallel strings anchored to such body portion, saddle means engaged against the strings and mounted for movement relative to such body portion and generally longitudinally of the strings, and means for securing said saddle means in a selected longitudinally adjusted position but releasable so as to allow longitudinal movement of said saddle means relative to the body portion, the improvement comprising gear-actuated adjustment means including a gear and gear teeth intermeshed with said gear for effecting adjustment of the longitudinal position of said saddle means when the securing means is released.

2. In a guitar-like musical instrument having a body portion, a head portion, several generally parallel strings having opposite ends anchored, respectively, to such head and body portions and saddle means engaged against the strings at such body portion and movable generally longitudinally of the strings, the improvement comprising the saddle means including a separate saddle for each of the strings, each of said saddles having a row of gear teeth extending generally longitudinally of the strings, adjustment means including a gear intermeshable with said gear teeth for effecting adjustment of the longitudinal position of such saddle by turning said gear, and means for securing said saddles in selected longitudinally-adjusted positions.

3. In the instrument defined in claim 2, a bridge plate mounted on the body portion, each saddle being mounted on the bridge plate and having a slot elongated generally longitudinally of the strings, the securing means including locking screws having shanks received, respectively, in said saddle slots, said slots and their locking screws being offset from the corresponding strings.

4. In the instrument defined in claim 2, the row of gear teeth for at least one saddle extending along one longitudinal upright side of such saddle.

5. In the instrument defined in claim 2, a bridge plate mounted on the body portion, the saddles being mounted on slides movable relative to said bridge plate lengthwise of the strings, each slide carrying one saddle, and said slides being provided in pairs, the slides of each pair having adjacent longitudinal edges, respectively, one of such edges having the row of gear teeth and the other of such edges having the gear mounted therein and meshed with said gear teeth.

* * * * *